US005172438A

United States Patent [19]

Johenning

[11] Patent Number: 5,172,438

[45] Date of Patent: Dec. 22, 1992

[54] WATERBED MATTRESS WITH EQUALIZED EDGE SUPPORT

[75] Inventor: John B. Johenning, Beverly Hills, Calif.

[73] Assignee: Strata Flotation, Inc., Torrance, Calif.

[21] Appl. No.: 746,279

[22] Filed: Aug. 16, 1991

[51] Int. Cl.[5] ..... A47C 27/08

[52] U.S. Cl. ..... 5/451; 5/919; 5/920; 5/921

[58] Field of Search ..... 5/450, 451, 452, 422, 5/457, 458, 919, 921, 920

[56] References Cited

U.S. PATENT DOCUMENTS

| | | | |
|---|---|---|---|
| 3,864,768 | 2/1975 | Fraige et al. | 5/452 |
| 4,301,560 | 11/1981 | Fraige | 5/450 |
| 4,467,485 | 8/1984 | Hall | 5/450 |
| 4,517,691 | 5/1985 | Phillips | 5/450 |
| 4,577,356 | 3/1986 | Johenning et al. | 5/450 |
| 4,663,788 | 5/1987 | Pospisal et al. | 5/450 |
| 4,905,331 | 3/1990 | Hochschild, III | 5/450 |

*Primary Examiner*—Alexander Grosz
*Attorney, Agent, or Firm*—Flehr, Hohbach, Test, Albritton & Herbert

[57] ABSTRACT

Waterbed and mattress having a pair of elongated buoyant members are near the side edges of the mattress to provide additional support for a person resting near the edges of the bed. This additional support tends to equalize the support provided along the edge and toward the middle of the mattress so that a person resting near the edge remains in a level position. In the disclosed embodiments, the buoyant members are fabricated of a closed cell polyethylene foam and are attached to a wave reducing baffle structure which is also included in the mattress.

10 Claims, 1 Drawing Sheet

WATERBED MATTRESS WITH EQUALIZED EDGE SUPPORT

This invention pertains generally to waterbeds and, more particularly, to an improved waterbed and mattress in which a person resting near the edge of the mattress is supported in a level position.

One problem encountered waterbeds is a tendency for a person resting near the edges of the bed to rest in an unlevel position due to a lesser degree of support toward the edges. The support provided by a waterbed is a combination of buoyancy in the water and tension in the upper wall of the enclosure which contains the water. While the buoyant support is substantially uniform across the entire horizontal extent of the mattress, the amount of support due to tension in the upper wall decreases toward the edges. As a consequence, a person resting within a few inches of the edge can tilt as much as 5-10 degrees toward the edge.

Another problem with waterbeds is a tendency to "bottom out" or contact the rigid supporting surface beneath the waterbed mattress when sitting on the edge of the bed or when getting onto or off of the bed. There have been some attempts to overcome this problem by placing an air-filled tube or a thick foam cushion around the periphery of the mattress. However, such attempts were not successful because the air-filled tubes had a tendency to leak, and the foam cushions filled with water and sank. These techniques were not intended to solve the problem of tilting with which the present invention is concerned, and they did not solve that problem.

It is in general an object of the invention to provide a new and improved waterbed and mattress.

Another object of the invention is to provide a waterbed and mattress of the above character in which a person resting near the edge of the mattress is supported in a level position.

These and other objects are achieved in accordance with the invention by providing a waterbed and mattress in which a pair of elongated buoyant members are provided inside the mattress near the side edges thereof to provide additional support for a person resting near the edges of the bed. This additional support tends to equalize the support provided along the edge and toward the middle of the mattress so that a person resting near the edge remains in a level position. In the disclosed embodiments, the buoyant members are fabricated of a closed cell polyethylene foam and are attached to a wave reducing baffle structure which is also included in the mattress.

Figure 1:
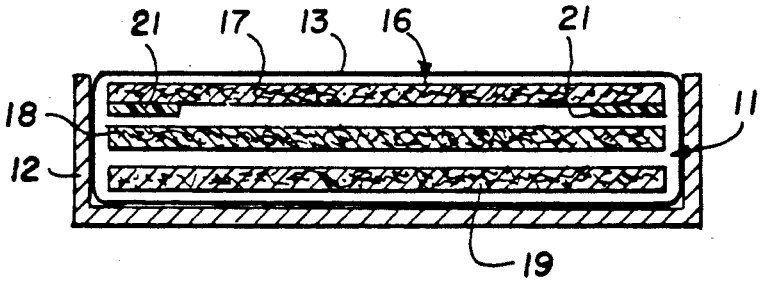
FIG. 1 is a cross-sectional view of one embodiment of a waterbed incorporating the invention.
Figure 2:
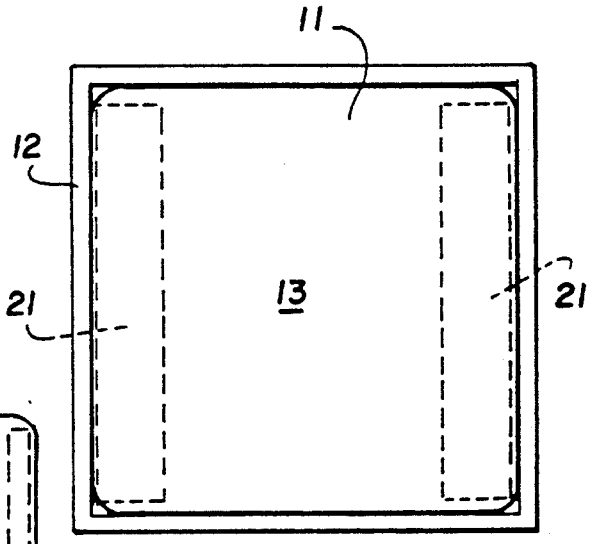
FIG. 2 is a top plan view of the embodiment of FIG. 1.

As illustrated in FIGS. 1-2, the waterbed has a mattress 11 of flexible material, such as 20 mil polyvinylchloride, and a rigid circumscribing frame 12 which provides lateral support for the water in the mattress. The mattress has a horizontally extending top wall 13 for receiving a person resting on the bed, with that person being supported by a combination of buoyancy in the water and tensioning of the top wall.

A baffle structure or insert 16 is disposed within the mattress to reduce the wave-like motion of water. In the embodiment illustrated, the insert consists of three horizontally extending pads or mats 17-19 of a fibrous material such as polyester fibers which float in the water in the chamber. Each of the pads or mats has a lateral extent corresponding to the top wall of the mattress, and the insert is retained in position within the chamber by suitable means such as tether straps (not shown).

Means is provided for providing additional support along the side edges of the mattress to equalize the support provided along the edges and toward the middle of the bed. In the embodiment of FIGS. 1-2, this means comprises strips 21 of closed cell polyethylene foam which extend lengthwise of the bed along opposite side edges of the mattress. The foam strips have a width on the order of 6 to 12 inches and a thickness on the order of ½ inch. These strips are attached to the under side of the upper fiber pad 17 to keep them in place near the edges of the mattress. The foam strips have a substantially greater buoyancy than the fibrous material, and they tend to hold up the edge portions of top wall 13 and provide increased buoyancy and tensioning of the wall along the edges. This tends to eliminate the difference in support between the middle and edge portions of the bed and permits a person to rest in a level position even within a few inches of the edges. The mattress illustrated in the embodiment of FIGS. 3-4 has a bladder or enclosure 26 of flexible material such as 20 mil polyvinylchloride, with a horizontally extending top wall 27 for receiving a person resting thereon. As in the embodiment of FIGS. 1-2, a person resting on the mattress is supported by a combination of buoyancy in the water and tension in the top wall.

Figure 4:
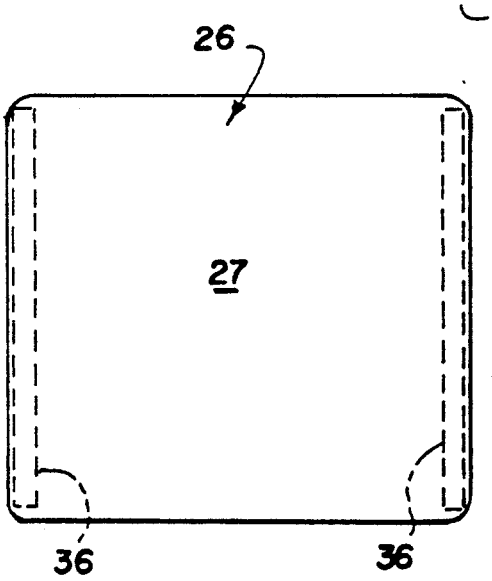
FIG. 4 is a top plan view of the embodiment of FIG. 3.
Figure 3:
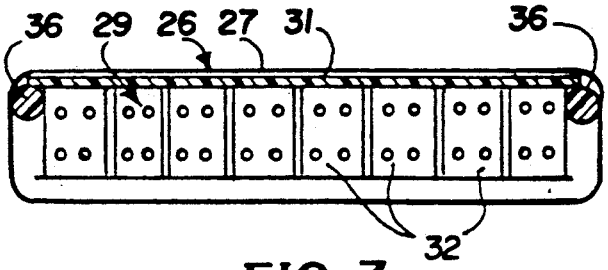
FIG. 3 is a cross-sectional view of another embodiment of a waterbed incorporating the invention.

As in the embodiment of FIGS. 1-2, a baffle structure or insert is provided for reducing wavelike motion of the water within the mattress. In the embodiment of FIGS. 3-4, the baffle structure 29 comprises a horizontally extending pad 31 of buoyant material which floats in the water beneath the top wall of the enclosure. A plurality of wave dampening hydraulic cells 32 depend from pad 31. These cells can be of any suitable known design and can, for example, be of the type shown in Ser. No. 07/395,714, filed Aug. 18, 1989 now U.S. Pat. No. 5,068,934 or Ser. No. 07/660,604, filed Feb. 22, 1991. The cells are distributed over substantially entire horizontal extent of the mattress. The baffle structure is retained in position within the mattress by suitable means such as tether straps (not shown).

As in the embodiment of FIGS. 1-2, means is provided for providing additional support along the side edges of the mattress to equalize the support provided along the edges and toward the middle of the bed. In the embodiment of FIGS. 3-4, this means comprises solid rods 36 of closed cell polyethylene foam which extend lengthwise of the bed along opposite side edges of the mattress. These rods are attached to the under side of foam pad 31 between the outermost rows of cells and the side edges of the mattress. The rods have a diameter on the order of 2 inches and a substantially greater buoyancy than the foam pad and the rest of the baffle structure, and they tend to hold up the edge portions of top wall 27 and provide increased buoyancy and tensioning of the wall along the edges. As in the embodiment of FIGS. 1-2, this tends to eliminate the difference in support between the middle and edge portions of the bed and permits a person to rest in a level position even within a few inches of the edges.

It is apparent from the foregoing that a new and improved waterbed and mattress have been provided. While only certain presently preferred embodiments have been described in detail, as will be apparent to those familiar with the art, certain changes and modifications can be made without departing from the scope of the invention as defined by the following claims.

I claim:

1. In a waterbed: a water-filled mattress having a horizontally extending top wall for supporting a person resting thereon, a horizontally extending baffle within the mattress for reducing wave action in the water, and a pair of elongated strips of buoyant material attached to the baffle along opposite side edges thereof in close proximity to the side edges of the mattress, said strips having a width on the order of at least 6 inches and being of sufficient buoyancy to hold a person resting near the side edges of the mattress in a substantially level position.

2. The waterbed of claim 1 wherein the strips of buoyant material are fabricated of a closed cell polyethylene foam.

3. The waterbed of claim 1 wherein the baffle comprises a pad of buoyant fibrous material.

4. The waterbed of claim 3 wherein each of the strips has a width on the order of 6 to 12 inches and a thickness on the order of ½ inch.

5. In a waterbed: a water-filled mattress having a horizontally extending top wall for supporting a person resting thereon by a combination of buoyancy in the water and tension in the top wall, with the buoyancy being substantially constant across the mattress and the tension in the top wall tending to decrease toward edges of the mattress, a horizontally extending baffle within the mattress for reducing wave action in the water, and means comprises a pair of elongated members fabricated of a closed cell polyethylene foam and having a width on the order of at least 6 inches floating in the water along opposite side edges of the mattress for holding up the edge portions of the top wall to provide increased buoyancy and tensioning of the top wall along the edges and thereby eliminate differences in support between the middle and edge portions of the mattress so that a person can rest in a level position without tilting near the side edges of the mattress.

6. In a waterbed mattress: a flexible enclosure having a horizontally extending top wall for receiving a person resting thereon, a pad of buoyant fibrous material adapted to float horizontally within the enclosure beneath the top wall for reducing wave action of water in the enclosure, and strips of material having a greater buoyancy than the fibrous material extending along opposite side edges of pad for providing additional buoyancy along the edges of the mattress for supporting a person resting near the edges, each of said strips having a width on the order of at least 6 inches and being of sufficient buoyancy that a person resting near one of the edges of the mattress is supported in a substantially level position without appreciable tilting.

7. The waterbed mattress of claim 6 wherein the strips of material are fabricated of a closed cell polyethylene foam.

8. The waterbed of claim 6 wherein each of the strips has a width on the order of 6 to 12 inches and a thickness on the order of ½ inch.

9. In a waterbed mattress: a flexible enclosure having a horizontally extending top wall for receiving a person resting thereon, a pad of buoyant material adapted to float horizontally within the enclosure beneath the top wall with a plurality of wave dampening cells depending therefrom for reducing wave action of water in the enclosure, said cells extending throughout substantially the entire extent of the top wall, and elongated rods having a greater buoyancy than the pad positioned on the under side of the pad between the outermost ones of the cells and the side edges of the mattress for providing additional buoyancy along the side edges of the mattress to support a person resting near the side edges.

10. The waterbed mattress of claim 9 wherein each of the elongated rods is fabricated of a closed cell polyethylene foam.

* * * * *